United States Patent [19]

Schachter

[11] 4,103,634

[45] Aug. 1, 1978

[54] CREST AND METHOD OF MANUFACTURE

[76] Inventor: Joseph D. Schachter, 866 Elm St., Winnipeg, Manitoba, Canada

[21] Appl. No.: 757,664

[22] Filed: Jan. 7, 1977

[30] Foreign Application Priority Data

Oct. 7, 1976 [CA] Canada ..... 262935

[51] Int. Cl.[2] ..... D05C 17/00

[52] U.S. Cl. ..... 112/439; 112/266

[58] Field of Search ..... 112/266, 439, 410; 2/246; 40/129 A; 101/9, 407

[56] References Cited

U.S. PATENT DOCUMENTS

| | | | |
|---|---|---|---|
| 3,816,211 | 6/1974 | Haigh | 112/439 X |
| 3,992,988 | 11/1976 | Dwyer | 101/407 R X |

*Primary Examiner*—Werner H. Schroeder
*Attorney, Agent, or Firm*—Charles A. Laff; J. Warren Whitesel; Howard B. Rockman

[57] ABSTRACT

A method of manufacturing chenille crests comprising, preparing a large block of chenille material many times the size of an individual crest by Moss stitching background material with white thread, applying by heat transfer a heat transferable and washable coloring ink in the form of crest designs, to the surface of the chenille material, cutting the chenille material along the outline of the crest designs, stitching the cut chenille material along the edges to a felt type backing material, and cutting the backing material outside of the stitching to form complete individual crests.

11 Claims, 7 Drawing Figures

CREST AND METHOD OF MANUFACTURE

This invention is a method for manufacturing textile crests, and is particularly useful in the manufacture of chenille crests.

Chenille has been very popular as crest material since the creation of the first chenille crests. However, the manufacture of these crests has required a substantial amount of hand work.

Chenille is a material which has a surface with a raised stitch, sometimes called a Moss stitch, to impart a soft, carpet-like surface. The general method of manufacturing chenille crests is to first pre-mark a crest design or pattern on background cloth. The design is then outlined with stitching. Background areas of the design are then stitched in, using the Moss stitch, followed by the details, and any required lettering.

The Moss stitch is normally applied by handoperated machines, which create lines of raised loops. By manually rapidly maneuvering the machine in circles, a filled effect is achieved by overlapping the lines of stitching. This is sometimes called "chenilling" or "filling".

Once the basic crest has been completed within the outlines, the various details are added or filled in by a highly skilled chenille machine operator, and are sometimes added freehand. Some crests having details of great intensity and small size must be processed by specialized embroidery or other means.

When the above has been completed, the crest is either hand or die cut outside the outer outline of the crest design or pattern.

Clearly, the above process is labour-intensive, and therefore is expensive.

The present invention provides means for making chenille crests with substantially reduced labour cost. It has been surprisingly found that the chenille material can be imprinted with a specialized ink, whereas it had been previously found that inks either lie on the surface or are soaked heavily into the body (leaving little surface colour) of the chenille, due to the nature of the fabric, and could not stand up to the abrasion, flexing, creasing, pressing, cleaning, exposure to weather, and calendering to which chenille crests are often exposed. Consequently for the first time a printed, and therefore a low cost, chenille crest can be manufactured. Furthermore, large numbers of crests can be produced simultaneously without need of a substantial amount of the previous manual detail work.

The inventive method is shown in the attached drawing, wherein.

Figure 4:
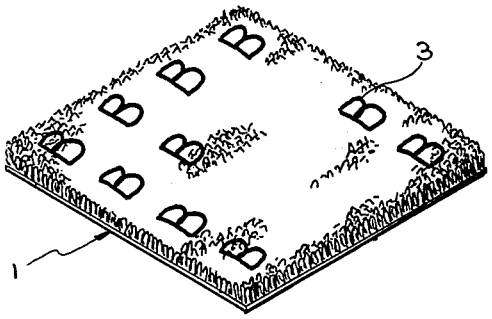
FIG. 4 is a perspective view of the block of chenille of FIG. 1 after the designs of FIG. 2 have been transferred by the step depicted in FIG. 3.
Figure 5:
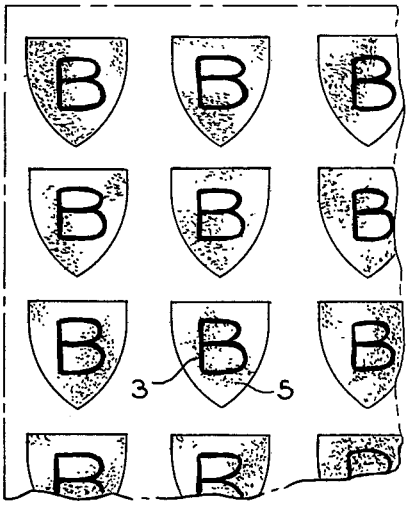
FIG. 5 shows schematically the processed chenille block of FIG. 4 after having been cut into individual crests.
Figure 6:
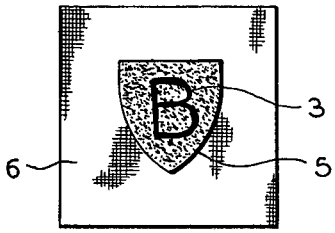
FIG. 6 is a plan view showing one of the crests which has been attached to a felt backing.

In the preferred embodiment, the method of manufacturing chenille crests comprises preparing a block 1 of chenille material by Moss stitching background material with white thread, and then applying by heat transfer (FIG. 4) a heat transferable and washable sublistatic colouring ink in the form of a crest design to the surface of the chenille material. The chenille material is then cut (FIG. 5) along the outline of the crest design and the outer raw cut periphery is stitched to provide a backing. Where an outline colour is to be provided, the aforenoted raw edge is stitched to a backing material (FIG. 6). The backing material is then cut (FIG. 7) at a distance, such as ¼ inch, around the periphery of the crest.

Of course, the size of the block 1 will depend on the number of crests to be simultaneously produced, which may be as small in number as 1.

More generally, the inventive method comprises preparing a large block 1 of crest material many times the size of an individual crest, printing a multiplicity of crest designs on the block, cutting each of the crest designs along its outline from the block, and stitching to bind the raw cut edge of each of the crests.

While felt crests have previously been made with inks imprinted on their surface, the inks, due to their negligible penetration of the fibres and brittle quality, tend to chip and degrade in a short period of time. Other textile inks have been found to be unsuitable for chenille crests due to their excessive, or poor, penetrability in chenille material, mechanical properties, poor weatherability, fading, etc.

I have found that chenille material can be printed with various colours of sublistatic ink. A source of a suitable ink is Marler Textiles, Deer Park Road, London, England, which ink is sold under the Trade Mark "Marlertex". I prefer to print an inverse of the crest design in full colour on a paper carrier prior to transfer to the chenille material.

The sublistatic ink can be used on chenille material fabricated using polyester, polyamide, diacetic or triacetic thread or mixtures thereof. Preferably the thread used is white in colour, although other colours can be used for background. Where other colours are used, the ink to be printed should be such as to allow for a combination of ink and background thread colour to form a final desired colour. Orlon thread has been found to be particularly suitable for chenille in this process.

Figure 1:
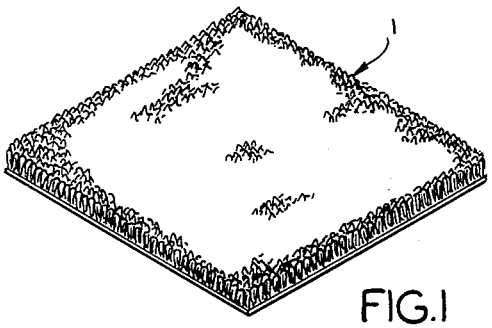
FIG. 1 shows, in perspective, a block of chenille material, before the processing begins.
Figure 2:
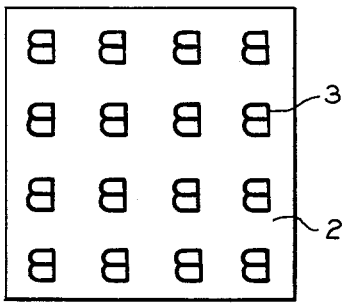
FIG. 2 shows a sheet of paper with a matrix of designs which are to be transferred to the surface of the chenille material.
Figure 3:
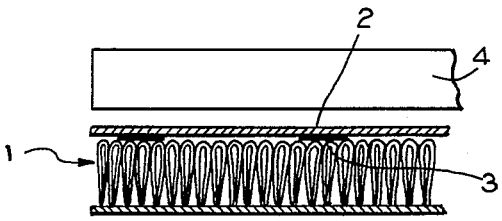
FIG. 3 is a side elevation, partially in cross section, showing the designs being transferred to the chenille.

The prepared paper 2 transfers carrying the ink design 3 in inverse are laid over the top surface (FIG. 3) of the prepared chenille blocks 1, and heat is applied from an iron 4, typically at 300° F., to transfer the ink 3 to the chenille material. Substantial and sufficient penetration of the chenille fibres has been found to occur, provided the above-noted kinds of fibre thread are used.

It is preferred that a line outline of the crest be transferred to the chenille to facilitate accurate handcutting of each crest 5 (FIG. 5) form from the chenille block.

Once the chenille crest form has been cut from the chenille block (FIG. 5), its edges are bound by stitching using one of the well known binding stitches.

Figure 7:
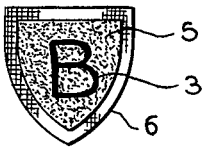
FIG. 7 is a plan view of the crest of FIG. 6 after the backing has been cut away to form a finished product.

Crests with a background outlining the periphery to, say, ¼ inch, can be produced by either of the following procedures. Following the cutting of the crest from the chenille, and prior to binding, the crest 5 is laid on a backing material 6 such as felt of contrasting colour. The edges of the crest are bound to the backing material using, for example, the zig-zag or satin cover stitch, which both fixes the background material to the crest, and also binds the raw edges of the crest. The backing material is then cut (as shown in FIG. 7) either by hand or by die, a predetermined distance from the binding.

In the alternative, the chenille block is placed upon an equal sized block of backing material, such as felt, and the outline of each crest design is stitched, using a binding stitch, to the backing material. The chenille is then cut just outside the binding, and in a further step, the backing material is cut at an appropriate distance around the outside of the binding material.

This process can also be directed to other types of crest material than chenille. In addition, a heat-transferred printed design can be combined with an at least partly hand-produced chenille stitching design in which specialized areas of the crest are Moss stitched using intense colour variation: internal binding or other specialized stitches can also be combined with the printed design. The specialized stitching in this case can be either added to the printed design either before or after cutting of each crest of the blocks of material.

For the first time a chenille crest is thus produced which has a printed design, free of the requirement for embroidery or specialized detail chenille stitching, which crest can be safely made the subject of abrasion, flexing, creasing, pressing, cleaning, calendering, and exposure to weather.

Other variations in the improved method of manufacturing crests may now occur to persons skilled in the art understanding this invention. All are considered within the scope of this invention as defined in the appended claims.

The embodiments of the invention in which an exclusive property or privilege is claimed are defined as follows:

1. A method of manufacturing chenille crests comprising:

(a) preparing a large block of chenille material many times the size of an individual crest by Moss stitching background material with white thread, (b) applying by heat transfer a heat transferable and washable sublistatic colouring ink in the form of crest designs, to the surface of the chenille material, (c) cutting the chenille material along the outlines of the crest designs, (d) stitching the cut chenille material along the edges to a felt type backing material, and (e) cutting the backing material outside of the stitching to form complete individual crests.

2. A method of manufacturing chenille crests as defined in claim 1 in which the ink is a sublistatic ink and the Moss stitching is formed of the chenille material made with thread of one or more of fibres selected from the group consisting of polyester, polyamide, diacetate and triacetate.

3. A method of manufacturing chenille crests as defined in claim 1 in which the ink is a sublistatic dry ink applied from a paper transfer, and in which the Moss stitching of the chenille material is done using orlon thread.

4. A method of manufacturing crests comprising:

(a) preparing large blocks of crest material many times the size of an individual crest, (b) printing a multiplicity of crest designs on said block, (c) cutting each of the crest designs along the outline from said block, and (d) stitching to bind the raw cut edge of each of the crests by stitching the edge of each of the crest designs to a backing material prior to the cutting step, the cutting step comprising cutting both the backing and block of crest material a predetermined distance around the outside of the stitching at the same time, then cutting the crest material but not the backing a smaller predetermined distance outside of the stitching to form complete individual crests.

5. A method of manufacturing crests comprising:

(a) preparing large blocks of crest material many times the size of an individual crest by Moss stitching a large area of background material with a single color thread to form chenille material, (b) printing a multiplicity of crest designs on said block, (c) cutting each of the crest designs along the outline from said block, and (d) stitching to bind the raw cut edge of each of the crests.

6. A method of manufacturing crests as defined in claim 2 in which the printing step is performed by applying heat to a dry sublistatic multicoloured ink transfer in contact with the surface of the block.

7. A crest comprising a chenille body having a surface containing a coloured design imprint of sublistatic ink, and stitched bound edges.

8. A crest as defined in claim 7 in which the stitched bound edges affix a backing material to the chenille body, and at the same time bind the raw edges of the crest.

9. A method of manufacturing crests comprising:

(a) preparing a piece of chenille material no smaller than the size of a crest by Moss stitching background material with thread, (b) printing a crest design on the chenille material with sublistatic ink, (c) cutting the outline of the crest design out of the chenille material, and (d) stitching the outer edge of the cut crest to bind the raw cut edge.

10. A method of manufacturing crests as defined in claim 5 in which the raw edges of the cut design of crest material are stitched to a backing material, and including the further step of cutting the backing material around the outer edge of the stitching to form complete individual crests.

11. A method of manufacturing crests comprising:

(a) preparing large blocks of crest material many times the size of an individual crest, (b) printing a multiplicity of crest designs on said block by applying heat to a dry sublistatic multicolored ink transfer in contact with the surface of the block, (c) stitching the edge of each of the crest designs to a backing material.

(d) cutting each of the crest designs along the outline from said block by cutting both the backing and the block of crest material a predetermined distance around the outside of the stitching at the same time, then cutting the crest material but not the backing a smaller predetermined distance outside of the stitching to form complete individual crests.

* * * * *